United States Patent [19]

Gurolnick

[11] 4,288,197

[45] Sep. 8, 1981

[54] CARTRIDGE PACKAGE

[76] Inventor: Richard C. Gurolnick, 1311 N. Rand Rd., Arlington Heights, Ill. 60004

[21] Appl. No.: 50,804

[22] Filed: Jun. 21, 1979

[51] Int. Cl.[3] ..... F42B 37/00; F42B 39/00

[52] U.S. Cl. ..... 414/786; 206/3

[58] Field of Search ..... 229/29 F; 206/3; 414/786

[56] References Cited

U.S. PATENT DOCUMENTS

| | | | |
|---|---|---|---|
| 204,017 | 5/1878 | Frazier | 206/3 |
| 2,325,756 | 8/1943 | Eggebrecht et al. | 206/3 |
| 2,626,077 | 1/1953 | Marshall | 206/3 |
| 2,795,323 | 6/1957 | Amundsen | 206/3 |
| 2,877,891 | 3/1959 | Chartrand | 206/3 |
| 2,889,974 | 6/1959 | Sauvago | 206/3 |
| 3,113,689 | 12/1963 | Moussong | 206/3 |
| 3,424,298 | 1/1969 | Wallace et al. | 206/3 |
| 3,578,152 | 5/1971 | Hartley | 206/3 |
| 3,756,387 | 9/1973 | Chaney | 206/3 |
| 3,757,933 | 9/1973 | Banta | 206/3 |

FOREIGN PATENT DOCUMENTS

| | | | |
|---|---|---|---|
| 865206 | 2/1941 | France | 206/3 |

*Primary Examiner*—Joseph Man-Fu Moy
*Attorney, Agent, or Firm*—Michael Piontek

[57] ABSTRACT

A cartridge package is provided which may be formed from a single board or blank, and if desired, a transparent piece, the latter providing for an attractive display of the package contents. The cartridge package is constructed to facilitate assembly of the package and the loading of the contents therein, while yet facilitating easy use by the shooter. The cartridge package permits the shooter to conveniently carry the package on his person and/or to easily load the shooter's weapon. To this end, the cartridge package can be carried in one hand while the weapon to be loaded is carried in the other, the fingers of the one hand holding the package being able to readily pluck a cartridge from the package, with the rim of the cartridge passing through the board, and then load it into the weapon.

2 Claims, 8 Drawing Figures

CARTRIDGE PACKAGE

DISCLOSURE

This invention relates to a cartridge package, and more particularly to a cartridge package which is inexpensive to make, attractive to display and convenient to use.

BRIEF DISCUSSION OF THE PRIOR ART

Various packages for cartridges and shells are known, such as shown in U.S. Pat. No. 260,153. Packaging made from one-piece cardboard blanks have been used with openings to receive the cartridges and to hold them in spaced positions, such as shown in U.S. Pat. No. 2,325,756. In the latter package, the cartridges are usually inserted and removed from the apertured member, with only the bullet end passing through the aperture. Such cardboard packages are satisfactory for marketing cartridge or shells, but are not suitable for convenient use by the hunter in the field or the shooter at the range. Also, various plastic cartridge holders have been suggested, such as shown in U.S. Pat. No. 3,756,387. While these plastic containers are more attractive, they are also more complex and expensive to manufacture, and cartridge removal is still awkward and time consuming. While various attempts have been made to make a cartridge package or parts thereof wearable by the shooter so that he can carry the cartridges with him, such as shown in U.S. Pat. No. 3,578,152, they have not met with great success. Up until now, there has been no single cartridge package which has all of the foregoing desirable features, plus is inexpensive to manufacture, readily adaptable to modern assembly techniques, attractive, and facilitates use by the shooter.

BRIEF SUMMARY OF THE INVENTION

The present invention is a cartridge package which can be formed from a minimum of pieces, preferably a single cardboard blank and a transparent piece, the latter providing an attractive display. In its preferred form, the cartridge package of the present invention comprises a series of connected or integral panels, one of which contains a plurality of apertures. The cartridge package of the present invention is so constructed to facilitate assembly of the package and the loading of the contents therein, while yet facilitating easy use by the shooter. The cartridge package permits the shooter to carry the package with him and/or to permit him to easily load his weapon, which is carried in one hand, while the cartridge package is carried in the other, the fingers of the other hand being able to pluck cartridges from the package and then load them into the weapon. Unlike in the prior art, in the present invention, the cartridges are inserted into the package and apertures thereof, bullet end first, but are withdrawn from the package for use in the same manner, bullet end first, with the cartridge continuing in the same direction. That is the other end or rimmed end of the cartridge is pulled through the aperture when the cartridge is withdrawn.

BRIEF OBJECTS OF THE PRESENT INVENTION

One object of the present invention is to provide a cartridge package which is economical and simple to manufacture.

Another object of the present invention is to provide a cartridge package having a transparent portion which allows immediate and convenient recognition by the retailer and purchaser of the cartridges therein and makes for an attractive display of the cartridges.

A further object of the present invention is to provide a cartridge package in which individual cartridges are readily accessible for removal for use.

Still another object of the present invention is to provide a cartridge package in which the individual cartridges are securely held in place for shipment and carrying purposes, but yet allow the shooter, readily with one hand, to hold the package and also to pick out a cartridge and load it into his gun, which is held in his other hand.

Yet, another object of the present invention is to provide a cartridge package which has economical and simple means to secure the package on the shooter's belt, facilitating its use.

These and other objects of the cartridge package of the present invention will become apparent from the following description and the accompanying drawings.

DESCRIPTION OF THE PREFERRED EMBODIMENTS

Figure 1:
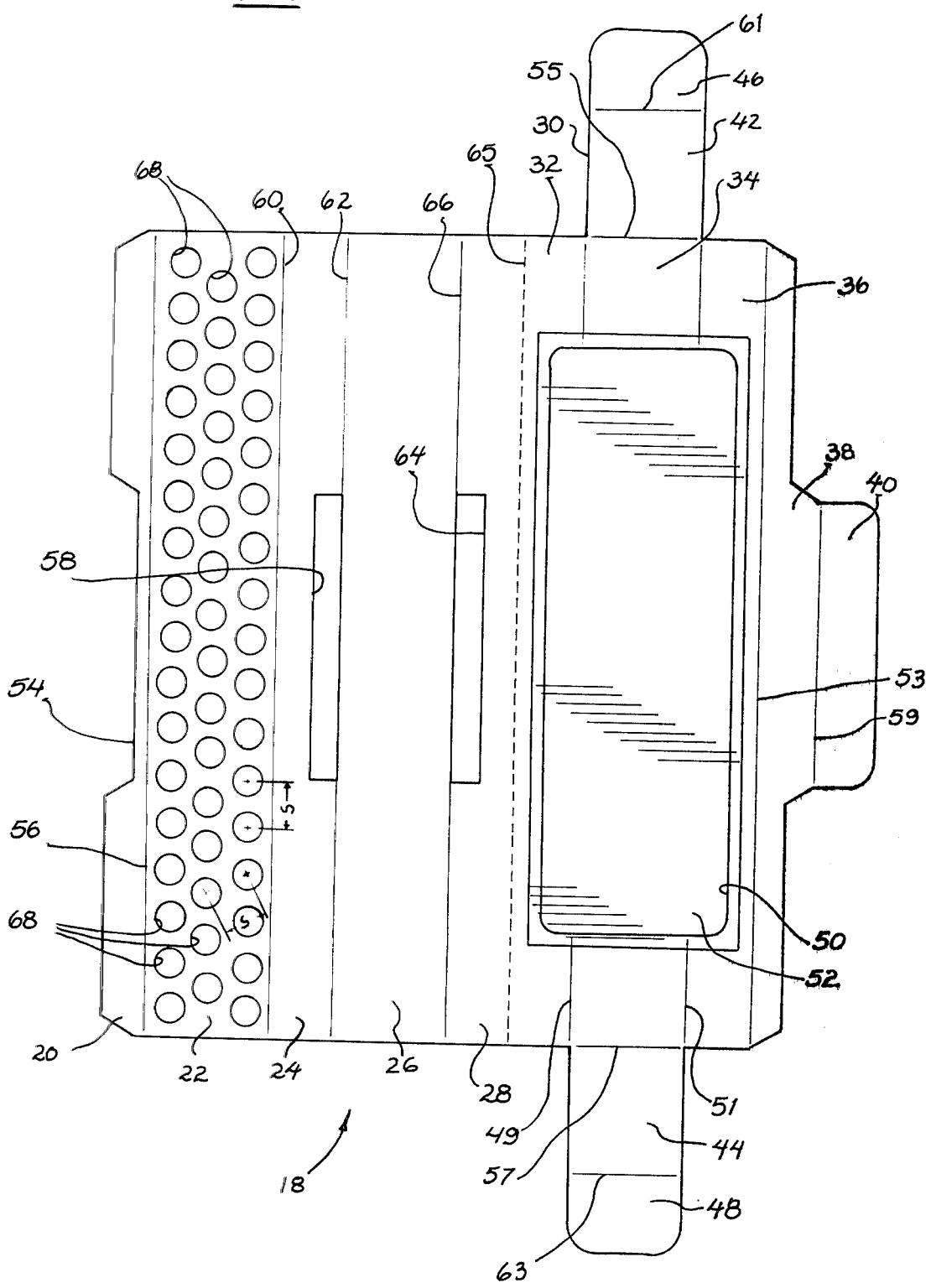
FIG. 1 is a plan view of a blank from which a first embodiment of a cartridge package of the present invention is made.
Figure 2:
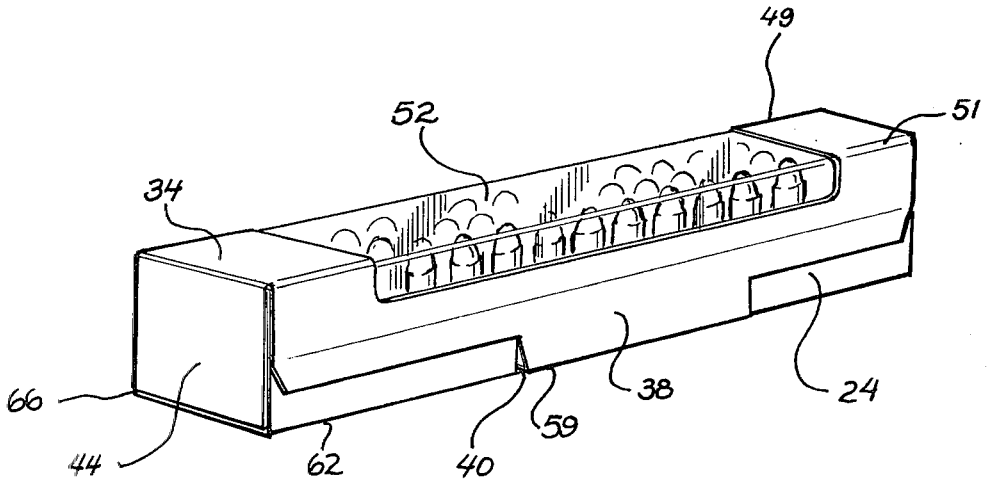
FIG. 2 is a perspective view showing the cartridge package of FIG. 1 in the form it would be sold to the shooter.

Referring to FIGS. 1 and 2, the first embodiment of cartridge package (FIG. 2) is made from a single or one-piece blank 18 (FIG. 1) of cardboard or other suitable sheet material cut or punched as shown and scored and/or folded as will be described. Chip board or railroad board 0.030 to 0.040 inches thick, is a suitable material.

Starting from the left of FIG. 1, the blank 18 has a glue panel 20, a cartridge retaining panel 22, a first lower side panel 24, a bottom panel 26, a second lower side panel 28 and a cover 30. Again continuing from the left of FIG. 1, the cover comprises, an upper, second side panel 32, a top panel 34, an upper, first side panel 36, a flap 38 with a closure tab 40. The cover 30 also includes a pair of end flaps 42 and 44 with end closure tabs 46 and 48. While the flaps and closure tabs are provided on the cover, they could have just as easily been provided on another portion of the blank. The cover 30 also has two top fold lines 49 and 51 and upper fold lines 53, 55 and 57 separating the flaps 38, 42 and 44, from panels 34 and 36, the closure tabs 40, 46 and 48 being separated from their respective flaps by lower fold lines 59, 61 and 63, respectively. Further, the upper side panel 32 of top 30 is separated from the lower side panel 28 by a perforation line 65. In addition, the cover 30 is cut-out at 50 to accommodate a transparent portion 52, which is secured to the margins of the opening 50.

The rectangular window or opening 50 is formed in the top panel 34 and extends to either side into the upper side panels 32 and 36. The transparent portion 52, in this instance, a cellophane sheet, or any like transparent material, is secured or fixed on the interior side of the margins of opening 50. Of course, if desired, the transparent panel 52 and opening 50 could be provided elsewhere, or eliminated. While the latter type package would not be as appealing, it may be less expensive, and would still have the other advantages of the cartridge package of the present invention.

For purposes of retaining the package of the shooter's belt, the first, lower side panel 20 has elongated cut away portion 54 formed therein adjacent the fold line 56. Similarly, the second, lower side panel 24 has a corresponding elongated rectangular slot 58 between the fold lines 60 and 62, and directly lies on the latter. The cut away portion 54 and slot 58 are positioned to be in alignment with one another when the package is assembled. The second, lower panel 28 has a slot 64, similar to slot 58, which also aligns with cut away portion 54 and slot 58, and actually lies adjacent the cut away portion 54, when the package is assembled. Again, similarly to slot 58, slot 64 lies directly on the fold line 66.

To locate the cartridges in the package, the retaining panel 22 is provided with a plurality of apertures 68 arranged in several rows. The apertures are of a diameter approximately equal to that of the caliber cartridge the package is designed for, eg., a 0.22 caliber package having 0.22 inch diameter apertures. Thus, the apertures will be smaller than the rim 70 (See FIG. 4) of the cartridge, the rim being somewhat larger than the other portions of the cartridge. The rows of apertures are staggered so as to provide adequate spacing between successive apertures in the same and adjacent rows so that the shooter can easily grip a cartridge which lies in any row with his fingers, but yet closely enough spaced to provide a good number of cartridges in the package. For example, though the blank of FIG. 1 is shown sized for 0.22 caliber cartridges, when assembled, it measures only approximately $6\frac{3}{8}$ inches long, $\frac{7}{8}$ inches high and $\frac{7}{8}$ inches wide, but yet holds fifty cartridges.

The spacing selected between the centers of the apertures 68 is important. Some of the factors to be considered in spacing the apertures 36 are: the thickness and strength of the material to be used for the panel 22, the caliber of cartridge to be contained in the package, the size of the rim on the cartridge, and the size of the average shooter's hand and fingers. While the package is somewhat larger than former packages wherein adjacent cartridges abut one another, it is still compact.

Suggested spacings between centers of adjacent apertures 68 (the dimension S in FIG. 1) for various size cartridges are shown below:

| Caliber | Approximately Spacing in Inches |
|---|---|
| .22 | .37 |
| .25 | .43 |
| .45 | .76 |

This distance can be expressed empirically as follows:

$$\textit{Approximate Spacing in Inches} = 1.7 \cdot \text{Caliber} \pm 0.1$$

The package formed from the blank 18 of FIG. 1 is shown in FIG. 2, and is easily assembled as follows: The bullet ends of the cartridges are inserted downwardly into apertures 68 in panel 22 manually or automatically. The cartridges are kept from moving completely through the apertures since the rims 70 (FIG. 4) of the cartridge are larger than the apertures. The blank 18 is then folded as follows: assuming the transparent portion 52 has already been fastened to the cover 30 and the panel 22 is relatively stationary, panel 20 is folded upwardly along line 56 and panel 24 is folded upwardly along line 60; the panel 26 is then folded to the left along line 62 over the rims of the cartridges: and the panel 28 is folded along line 66 downwardly so that cut away portion 54 and slot 64 generally align. Glue or some other adhesive is applied to the outside of panel 20 and/or the inside of panel 28 and they are then held and secured together. Now, panel 34 is folded to the right along line 49 so that panel passes below the bullet ends of the cartridges. Panel 36 is then folded along line 51 upwardly. The end flaps 42 and 44 are also folded upwardly along lines 55 and 57. Finally, to complete assembly, the closure tabs 40, 46 and 48 are tucked in between the interior of panel 26 and the rim ends of the cartridges to hold the flaps in place, the tab 40 extending into the slot 58 to do so. If desired, the closure tabs can be glued or otherwise fastened. Likewise, the flap 39 also could be lightly glued or secured.

The finally formed package, shown in FIG. 2, has no complex or additional pieces, provides a transparent covering portion at the top and sides, is an attractive display and provides easy recognition of the cartridge contents therein at a glance. Further, the cartridges are readily accessible by pulling up flaps 38, 42 and 44 and breaking the perforated line 65 between panels 28 and 32 to detach the cover 30 and exposes the cartridges. With the cover 30 detached, the cartridges are securely supported and retained in the remainder of the package by panels 22 and 26. However, the cover need not be detached, but can merely be opened and again reclosed, if desired. In the latter case, the perforations along line 65 would not be broken.

Figure 4:
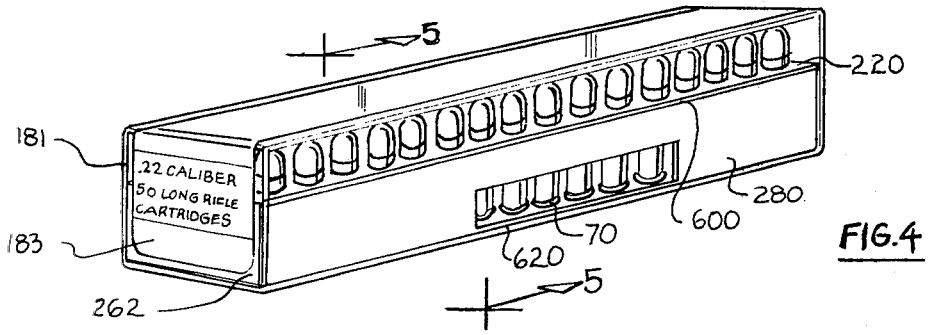
FIG. 4 is a perspective view showing the cartridge package made from the blank in FIG. 3 and an accompanying plastic sleeve which functions as a cover.
Figure 3:
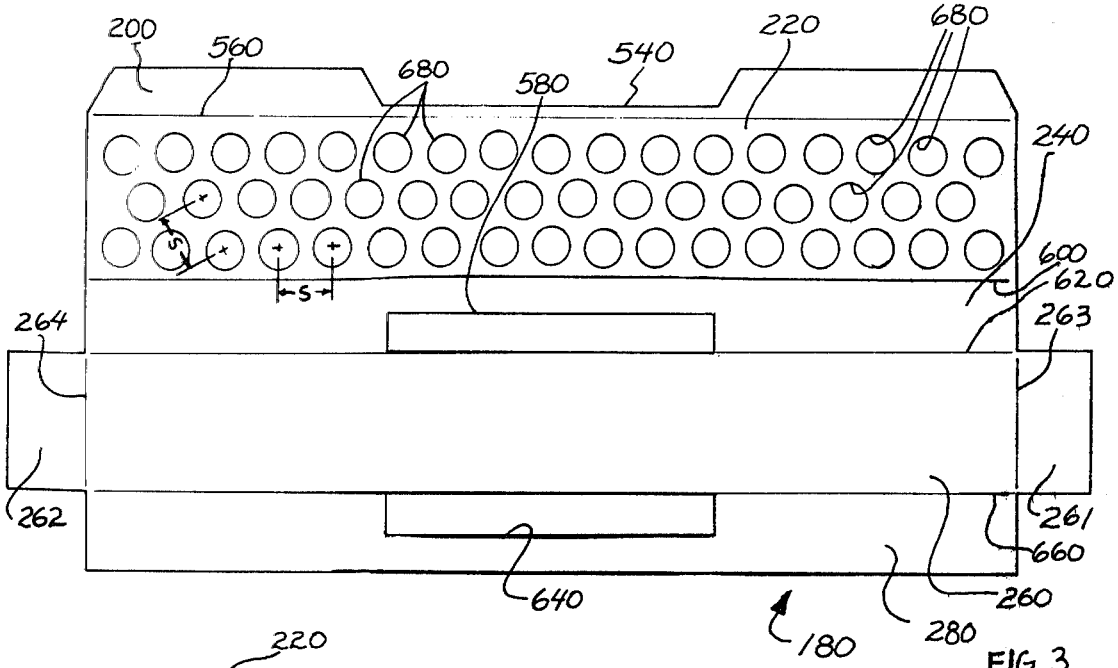
FIG. 3 is a plan view of a second blank from which a second embodiment of cartridge package of the present invention is made.

In FIG. 3, a second embodiment, blank 180, is shown for constructing the cartridge package of the present invention shown in FIG. 4. The package formed from the blank 180 fits inside a transparent, rectangular, in this instance square, sleeve 181. Sleeve 181 is formed in a known manner from any suitable transparent material, such as acetate plastic. Of course, if desired, the sleeve need not be transparent but could be opaque.

The blank 180 of the alternate embodiment is similar to the left portion of blank 18 shown in FIG. 1. Blank 180 is different from blank 18 in that the cover portion to the right of line 65 of the blank 18 is omitted, the cover function being, instead, performed by the sleeve 181. Thus, in blank 180, what corresponds to perforation line 65 in blank 18, is a cut line 165. A further difference noted is that panel 260 of blank 180 has two end tabs 261 and 262 separated by fold lines 263 and 264. Of course, if desired, end tabs could have extend from other panels or been made longer in length. All other portions of blank 180 are identical to corresponding portions of blank 18 and are given similar numbers which are ten times larger. So, for example, panels 20 and 22 of blank 18 correspond to panels 200 and 220 of blank 180.

In the second embodiment, the blank 180 is formed in a manner similar to that described for blank 18, except the operations to form the cover 30 of blank 180 are omitted. Instead, the assembled blank 180 with the cartridges inserted therein is merely slide into the sleeve 181, and the ends closed by an adhesive sticker 183 which carries the necessary printed and any desired display information. Of course, two stickers could be used, one at each end, so that the package at its top, center would be unobstructed.

Figure 5:
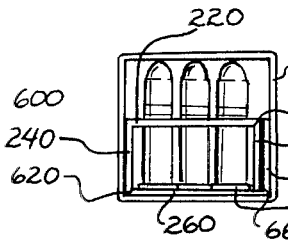
FIG. 5 is a cross-sectional view taken along the lines 5—5 of FIG. 4 showing the cartridges positioned in the package with the cover in place.
Figure 6:
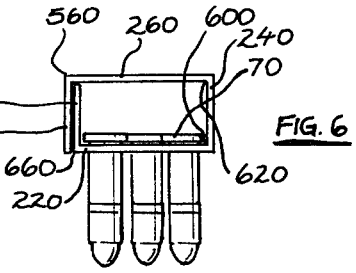
FIG. 6 is a view similar to FIG. 5, but with the cover removed and the package inverted.

FIGS. 5 and 6 illustrate the manner in which the cartridges are supported in various positions in the package of the present invention. It should be understood that while the second embodiment is shown in these figures, the first embodiment will function in a similar manner. In the position of FIG. 5, which represents the condition for display and transport, the cartridges are securely supported by panels 220, 260 and the sleeve 181. In the first embodiment, the support for the bullet end would be provided by panel 34 and cellophane 52, instead of the sleeve 181.

In field use, as represented in FIG. 6, after the cover or sleeve 181 is removed, the cartridges are retained as each cartridge casing rim is trapped between margins of its aperture 680, which as previously described, is diametrically smaller than the rim, and the panel 260. However, each of the individual cartridges can be or is exposed as shown in FIG. 6, and have considerable freedom of movement or "wiggle" should it be moved, as represented by the dashed lines in FIG. 6.

Figure 7:
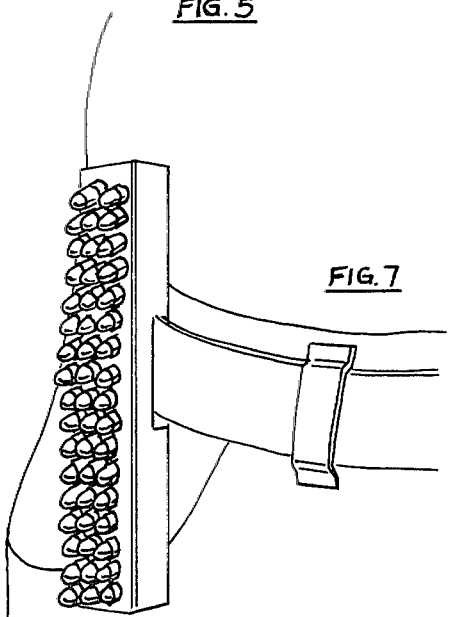
FIG. 7 is a perspective view of the cartridge package of the present invention mounted on a belt of the shooter.

FIG. 7 illustrates how the cartridge package 18 or 180 of the present invention may be mounted on a shooter's belt. The belt is inserted through slots 58 and 64 or 580 and 640 and placed around the waist of the user so that the bullet ends of individual cartridges project outward. The cartridges can then be readily removed by grasping their bullet ends and pulling their rims through the aperture 68 or 680 with thumb and forefinger of one hand and quickly loaded into the gun, the gun being held in the other hand of the shooter. Thus, it is apparent that the gun, or any other auxiliary loading mechanism, can be easily and quickly loaded. The spacing between the apertures and the fact that the cartridges are not held in a fixed position, but are somewhat movable or can "wiggle" facilitate this operation. Of course, the apertures and material chosen for the package are such that they permit easy withdrawal of a selected cartridge, but yet hold the remaining cartridges in place, until, they, in turn, are withdrawn.

Figure 8:
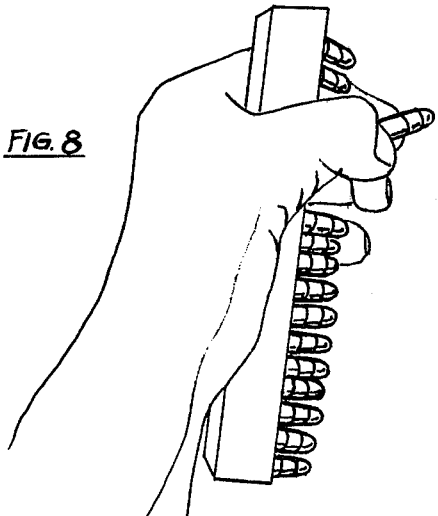
FIG. 8 is a perspective view showing the manner in which a shooter, with a single hand, can hold the cartridge package of the present invention and remove a cartridge therefrom, preparatory to loading it into his weapon.

Referring to FIG. 8, an outstanding feature of cartridge package 18 or 180 of the present invention is the ability to remove individual cartridges from the package solely with the hand that is holding the package. With the bottom panel 26 or 260 of the package facing the palm of the hand and the fingers and thumb encircling the package, the user can readily pluck an individual cartridge out, with its rim passing through the aperture 36 or 360 using only the thumb and forefinger as shown. Maintaining the same position, the user can, by relatively moving his hand holding the separated cartridge and package toward the gun, held in the other hand, insert the separated cartridge into the gun. About the only limitation on the package is that it be small enough in width and height to permit the user to grasp the selected cartridge with his finger and thumb. However, as a selected cartridge can be gripped almost any where above the panel 22 or 220, this is not difficult or a severe limitation.

While only two embodiments of the cartridge package of the present invention have been illustrated and described, it is to appreciated that modifications and variations thereof can be made, while still falling within the scope of the present invention as set forth in appended claims, such as, for example, having four or more rows of cartridges, if the packages is not to be used for one hand loading.

What is claimed is:

1. A method of using a cartridge package having a cartridge retaining panel with spaced apertures therein for cartridges having bullet ends smaller than the apertures and rim ends larger than the apertures, comprising the steps of:

a. inserting the bullet ends of the cartridges in one direction through the spaced apertures in the cartridge retaining panel, b. folding another portion of said package over the rim ends of the cartridges so the rims of the cartridges are located between the other portion and cartridge retaining panel, c. securing the cartridge retaining panel and other portion together to retain the cartridges, d. holding the package in one hand with the bullet ends pointing away from the palm, e. encircling a portion of the package and cartridges extending therefrom with the thumb and fingers of the one hand holding the package, and f. manipulating a finger and thumb on the one hand holding the package to withdraw a cartridge from the package in said one direction with the rim of the cartridge being withdrawn being forced through its respective aperture.

2. A method as in claim 1, comprising the step of:

a. providing belt mounting slots in the cartridge package adjacent the other portion, and b. mounting the package on the belt of the user by the belt mounting slots.

* * * * *